United States Patent [19]

Sugita

[11] 4,025,963

[45] May 31, 1977

[54] PRINTED CLOTH

[76] Inventor: Kiyo Sugita, 21-15, Irumagawa 2-chome, Sayama 350-13, Japan

[22] Filed: June 16, 1975

[21] Appl. No.: 587,239

Related U.S. Application Data

[63] Continuation-in-part of Ser. No. 474,301, May 29, 1974, abandoned.

[52] U.S. Cl. ..... 2/243 B

[51] Int. Cl.[2] ..... A41D 27/00

[58] Field of Search ..... 2/243 R, 243 B; 33/11-16, 17 R, 17 A

[56] References Cited

UNITED STATES PATENTS 1,934,282 11/1933 Telzerow ..... 2/243 B 2,477,890 8/1949 Montagna ..... 2/243 B X

*Primary Examiner*—G. V. Larkin

[57] ABSTRACT

A plain fabric having separate areas printed with color and/or design and with the areas being formed to provide the component parts for assembly into a completed garment. The peripheral borders of the respective areas provide the standard line for cutting and immediately contiguous to these peripheral borders, at prescribed lengths thereof, which are not to be cut, are color printed portions shaped to provide facing cloth when turned up and seamed to the adjacent area of cloth. Other areas of the fabric, spaced away from the separate areas are printed to the shape of other parts of the garment and are separately cut from the fabric.

6 Claims, 1 Drawing Figure

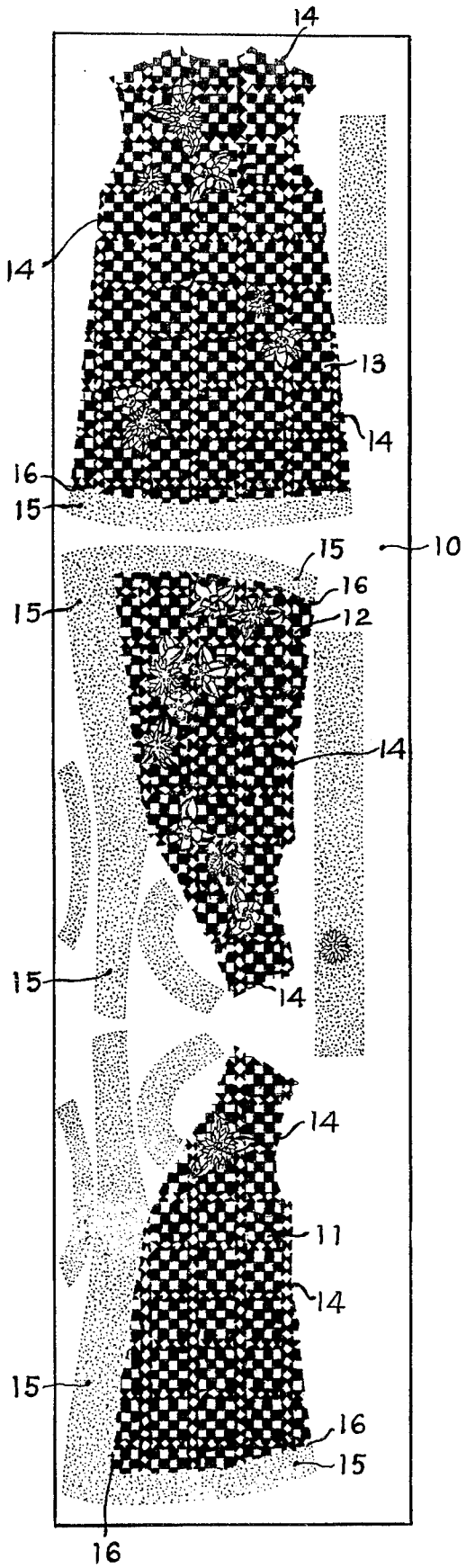
14
14
13
14
16
15
15
10
15
16
12
14
15
14
14
11
14
15
16
15
16

PRINTED CLOTH

BACKGROUND OF THE INVENTION

This is a continuation-in-part of my application Ser. No. 474,301 filed 5/29/74 now abandoned.

The present invention relates to fabrics on which design areas are printed to define component parts of a garment and when cut from the fabric these sections can then be assembled into the completed garment. The printing can be accomplished by means of the drawing transfer process and/or dyeing printing.

Hitherto, it is well known, in the case of tailoring or dress-making of European or Japanese clothes, to select a paper pattern fitting to a selector's body style and a cloth pleasing to the selector. It is customary to draw impressed lines by a spatura on the cloth after taking the measurement and matching pattern of the cloth, and to cut and sew along the lines thereof. However, in the above case, though it is normal, the cloth and the paper pattern are nonrelative materials to each other, and the design pattern is printed on the cloth without consideration of pattern matching at those points where seams are to be provided. Consequently, it is not easy to determine a positioning of cutting lines of the cloth in connection with the pattern matching at these points where seams are required, and consequently it usually takes a long time and with the result that there is a large loss of waste pieces from the cloth.

It is desirable that clothes fitting well to the wearer's body style should be made easily at home at a low cost compared to the selling price of manufactured clothes.

OBJECT OF THE INVENTION

The first object of the present invention is to create and offer cloth for clothes to be made by even the non-professional easily and at low cost with relatively little labor and without wasting cloth in pattern matching.

Another object of the present invention is to create and offer a continuous cloth on which has been also printed a different color and/or pattern according to a wearer's taste to be used for accents in parts such as a pocket, a cuff, a collar, a belt and others.

SUMMARY OF THE INVENTION

According to the invention the main design areas are printed on a fabric or cloth and other areas are printed in the cloth immediately adjacent certain peripheral sections of the respective main design areas. When the respective main areas of the fabric are to be removed from the fabric for assembly into the whole garment the cutting line is along the peripheral border of the main design area and the peripheral borders of the adjacent other areas but there is no cutting at the line where the main areas and the other areas are contiguous. After the cutting the additional areas of the fabric are turned up and seamed directly to the design area with which they are associated.

DESCRIPTION OF A PREFERRED EMBODIMENT OF THE INVENTION

The present invention is achieved by means of dry transfer printing and/or dyeing.

On the one hand, the dry transfer printing to be utilized for the present invention is suited to cloth such as polyestel, polyamid 66, acetate, triacetate, acryl excluding modacryl, spandex, polyestel lame, benzoate which belong to synthetic fibre and such as wool, cotton, silk, linen which belong to natural fibre. But preferably the natural fibre is mixed less than 35% in comparison with the synthetic fibre. As an original paper for dry transfer printing has a weak adhesive power, it is possible to transfer easily on very thin fabric, single jersey etc., or also on nonwoven cloth, such as felt, frocky, pile and synthetic leather.

On the other hand, dyeing printing to be utilized with the present invention includes hand work and rolls, but excludes it by means of batik due to difficulties in making sharp lines and clear divisions. The dyeing printing is suited to cloth such as nylon, vinylon and acetate which belong to synthetic fibre, and such as wool, cotton, silk, linen which belong to natural fibre.

An example of how the invention may be performed is given below.

EXAMPLE 1

In advance let the tracing lines for tailoring be printed with overlapping on the same original paper on which a main print is performed, so that the main print and the tracing lines are transferred on the same side of a cloth at the same time. Relative positioning between the main print and the additional tracing lines are prearranged with consideration of pattern matching at the seaming, with the result that the pattern matching will be performed of itself at seaming by only cutting along the lines for tailoring.

EXAMPLE 2

In advance another original paper which is different from an original paper for the main print is prepared for the tracing lines. These said tracing lines are transferred on the reverse side of the cloth at the same time as the main print is performed, or at a later time than the main printing. The said reverse side printing is advantageous in that it is able to print the lines fitting to plural body styles such as slender, medium or plump, and to also add an explanatory drawing and/or description.

EXAMPLE 3

As a modification of the said example 2, the printed cloths and all varieties of the original papers on which have been printed the lines for tailoring are prepared in advance at a dry-goods store. A customer selects an original paper fitting to her body style from among many of them as well as a cloth she prefers. The said cloth and the said original paper are inserted in a pile in a simple transfer machine which has been installed in the store, so that the store can sell with transferring instantly on the cloth selected by customer and from the original paper also selected by her. In the above case treatment after transfer is not required and water is not required for the dry method. The follows that easy transfer printing can be done even in a small shop or store. Skill for transfer is not necessary, a shopgirl having normal intelligence can operate the said simple transfer machine, so that sharp lines will be printed instantly.

EXAMPLE 4

In advance figures are printed on an original paper, which figures consist of each division of clothing such as a collar, sleeves, lining cloths and others, to be made by seaming and all figures are separated by cutting along boarderlines of the figures. The said figures are then transferred on a continuous cloth from the said original paper, so that clothes will be made from the said continuous cloth without other cloth. The boarder-lines of the figures are found by divisions of colour, discolour, figure lines or combination thereof.

EXAMPLE 5

In the process of dyeing method by hand which main prints are formed on a cloth through cutting slits made at a printing, additional tailoring lines are made at the same screen, and are printed on the right side of the same cloth at the same time. However the lines tend to become thinner and thinner as the process is repeated due to the fact that the slits become clogged.

EXAMPLE 6

In case of a modification of the example 5 in which the tailoring lines are made at another printing screen, they are printed on the right or reverse side of a same cloth at a later time than the main printing.

EXAMPLE 7

In process of dyeing by inking rolls, another printing screen which is different from a main printing screen is prepared for the additional tailoring lines. Both screens are piled up on the right and reverse sides of the cloth repectively, they are inserted between a pair of the inking rolls, and so that the tailoring lines are printed on the reverse side of the cloth at the same time as the main printing is performed on the right side of the cloth.

EXAMPLE 8

Plural kinds of the tailoring lines by means of dyeing are printed on the reverse side of the cloth on which main print has been done by means of dyeing.

EXAMPLE 9

A modification of the example 4 is performed by means of dyeing.

EXAMPLE 10

The main printing is performed by means of dry transfer printing method, the additional tracing marks are performed by means of dyeing method.

EXAMPLE 11

The main printing is performed by means of dyeing method, the additional tracing marks are performed by means of dry transfer printing.

EXAMPLE 12

Cloth printed by the embodiment of the present invention may be used as teaching material at dressmaking schools.

EXAMPLE 13

Cloth printed by the embodiment of the present invention may also be used for an interior accessory such as a stuffed doll, a sewn toy, a seat or rear cushion and others.

As the present invention enables to print the additional tracing marks for tailoring on the cloth, it is possible to save not only the time and labor for pattern matching at the seaming, but also the large loss of waste pieces from cutting cloth, and to do easy dressmaking at the home of a non-professional saving the cutting charges to be paid to a dressmaker, and if necessary, also to make a sufficient clothes from a continuous cloth on which figures consisting of each divisions of the clothes such as a cuff, a collar, sleeves, a gusset, a lapel, pocket lapels, a belt, lining cloths and others have been printed. Further, the dry-goods store can supply a customer a cloth on which the dry-goods store transferred instantly the tracing marks for tailoring from the original paper selected by him on the reverse side on the said cloth also selected by him. Furthermore, cloths on which the additional tracing marks for dressmaking have been printed may also be used as a teaching material at dressmaking schools. Furthermost, the present invention enables to also utilize on cloth to be used for an interior accessory such as a stuffed doll, a sewn toy, a seat or rear cushion and others.

The drawing shows a printed fabric, from which a garment is made.

Referring to the drawing it can be seen that, on cloth 10, which is a plain fabric, various portions are printed in a design and/or color by well-known printing techniques such as described above. The main design areas 11, 12 and 13 represent the front portions and the back portion of a garment, in this case a dress. It will be noted that there are three peripheral edges 14 for each of the main design areas.

In addition it will be noted that immediately contiguous to certain peripheral lengths of each of the main design areas 11, 12 and 13 there are other areas 15, printed on the cloth 10 in color and/or by lines, and defining with main design areas the contact lines 16.

In addition to the above-described printed areas there are also further printed areas 17 which are separate from both areas 11, 12, 13 and 15. These are cut from the cloth to provide for pockets, cuffs, collars, belts, etc for the garment which is to be assembled.

When a prospective user has determined the particular design he or she wishes and a pattern suitable for him or her has been provided the main areas of the garment, such as areas 11, 12 and 13, are suitably printed on a cloth and at the same time the areas 15 and 17 are printed on the cloth.

The user now has a complete printed cloth from which the component parts of the garment to be assembled can be conveniently cut without waste of material or need to be concerned with matching border lines. It should be observed that by cutting along lines 14 and the outer edges of areas 15, and not at the common line between them, the main portions of the garment are complete after the areas 15 are turned up to their respective areas 11, 12 or 13 and seamed thereto.

Areas 17 are separately cut from the cloth 10 and utilized for their purposes in the garment.

What I claim is:

1. In a cloth, separate printed sections having a main design and with each section being defined by a border edge, and adapted, when cut from the cloth, to be assemble into a garment, the respective separate printed sections having, along at least a portion of the respective border edges additional printed sections defining facing for an associated respective separated printed section of the garment and being contiguous thereto, said additional printed sections being so configured that when the cloth is cut along the border edge of said respective separate printed sections, spaced from the border edge contiguous with said respective additional printed sections, and along an outer peripheral edge of said respective additional printed sections, the additional printed sections remain attached to their associated separate printed sections having the main design and are foldable to, and in matching relationship with said respective separate printed sections, whereby said separate sections can be secured together and said additional printed sections can be turned up, on said separate printed sections having the main design, for securement as facings thereto.

2. In a cloth as claimed in claim 1, wherein said additional printed sections are defined by lines.

3. In a cloth as defined in claim 1, wherein said additional printed sections are defined in color.

4. In a cloth as claimed in claim 1, further comprising further printed sections printed on the cloth in areas separated from both said printed sections having a main design and said additional printed sections, said further printed sections, when cut from the cloth, being usable as accessories for the garment.

5. In a cloth as claimed in claim 4, wherein said further printed sections are defined by lines.

6. In a cloth as defined in claim 4, wherein said further printed sections are defined in color.

* * * * *